United States Patent [19]

Sawluk

[11] 3,971,358

[45] July 27, 1976

[54] METHOD OF AND ARRANGEMENT FOR DRESSING OF GRINDING WHEELS

[75] Inventor: Wlodzimierz Sawluk, Hamburg, Germany

[73] Assignee: Ernst Winter & Sohn, Hamburg, Germany

[22] Filed: Apr. 29, 1974

[21] Appl. No.: 465,292

[30] Foreign Application Priority Data

Apr. 27, 1973 Germany ..... 2321477

[52] U.S. Cl. ..... 125/11 CD; 51/325

[51] Int. Cl.[2] ..... B24B 53/14

[58] Field of Search ..... 125/11 R, 11 CD; 51/325

[56] References Cited

UNITED STATES PATENTS

| | | | |
|---|---|---|---|
| 2,477,418 | 7/1949 | Polk | 125/11 CD |
| 2,482,785 | 9/1949 | Lohutko | 125/11 CD |
| 2,601,290 | 6/1952 | Hopkins | 125/11 CD |
| 2,689,434 | 9/1954 | Grobey | 125/11 CD |
| 3,822,689 | 7/1974 | Ohima | 125/11 DF |

*Primary Examiner*—Harold D. Whitehead
*Attorney, Agent, or Firm*—Michael J. Striker

[57] ABSTRACT

A grinding wheel is rotated and contacted with two driven dressing rollers which are so driven that they will remove material from the grinding wheel in alternately opposite dressing directions but at identical relative dressing speeds.

15 Claims, 5 Drawing Figures

METHOD OF AND ARRANGEMENT FOR DRESSING OF GRINDING WHEELS

BACKGROUND OF THE INVENTION

The present invention relates generally to the dressing and sharpening of grinding wheels, and more particularly to an improved method of dressing and sharpening and to an arrangement for carrying out the method.

It is already known from the art to dress and sharpen grinding wheels or discs. Diamond grinding wheels, and those which contain cubically-crystalline boron nitride as the grinding substance, have heretofore always been dressed and sharpened in two separate operating stages. Firstly, the wheel is dressed, for instance using silicone-carbide wheels as the dressing wheels, in order to restore the geometric configuration of the grinding wheel to the original shape. Subsequently the grinding wheel must be sharpened, for which a separate operation was heretofore required. Usually, a very soft silicone-carbide dressing wheel of a corundum dressing wheel were used, to remove binder material from the grinding wheel in order to expose diamond chips or boron nitride crystals of the grinding wheel which are bound by the binding material.

It is evident that it would be desirable to carry out both of these operations in a single step. Heretofore, this appeared impossible of achievement, because it is known that an increase in the dressing or cutting speed $v$ will result in a decrease of the cutting or dressing ability F and in an increase in the temperature T resulting from the friction. If the wear $S_B$ of the grinding wheel is to be considered in dependence upon the dressing speed $v$, then it is found in practice that the minimum wear is obtained at a certain specific dressing speed, the minimum wear being usually represented as the value $v_A$. If the dressing speed $v$ is increased beyond the minimum wear value $v_A$, or is decreased substantially below this value, this results in a substantial increase of the grinding wheel wear $S_B$.

These factors are true both of grinding operations in general, and of the dressing of a grinding wheel in particular, and it follows from them that the dressing of a grinding wheel should be carried out either at very high or at very low dressing speeds $v$. However, contrary to this general assumption it has been found that dressing at high dressing speeds $v$ does not produce satisfactory results because of the strong increase which takes place in the temperature prevailing in the area where dressing is carried out, that is where material is being removed. This temperature increase is, inter alia, the result of expansion of the dressing tool and of the thermal stresses which act upon the grinding wheel itself. Conversely, dressing at very low dressing speeds is also disadvantageous because as a general rule the equipment available for the dressing operation is not particularly sophisticated and not provided with arrangements for reducing the rotations of the grinding wheel to the extent necessary to obtain such low dressing speeds.

SUMMARY OF THE INVENTION

It is a general object of the invention to overcome the disadvantages of the prior art.

More particularly, it is an object of the invention to provide an improved method of dressing and sharpening a grinding wheel which avoids the disadvantages of the prior art as outlined above.

Another object of the invention is to provide a novel apparatus for carrying out the method.

In keeping with these objects, and with others which will become apparent hereafter, one feature of the invention resides in a method of dressing and sharpening a grinding wheel which, briefly stated, comprises the steps of rotating a grinding wheel, contacting the grinding wheel with at least one driven dressing roller, and dressing the grinding wheel by removing from it material with the dressing roller in alternately opposite dressing directions and at identical relative dressing speeds.

It is advantageous if not one but two dressing rollers are utilized which are driven jointly and whose relative dressing speeds are identical, whereas their respective dressing directions are opposite. A single roller can be utilized, but in this case opposite dressing directions (that is directions of material removal) at identical relative dressing speeds can be obtained only by varying—i.e., increasing or decreasing—the number of rotations of the dressing roller per unit of time. By contrast, if two dressing rollers are used they can simultaneously remove material in mutually opposite directions, and by utilizing appropriate drives which provide the desired peripheral speeds of the two grinding rollers with respect to the peripheral speed of the grinding wheel, identical relative dressing speeds can be obtained. This, then, assures that uniform conditions will act upon the grinding wheel being dressed.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
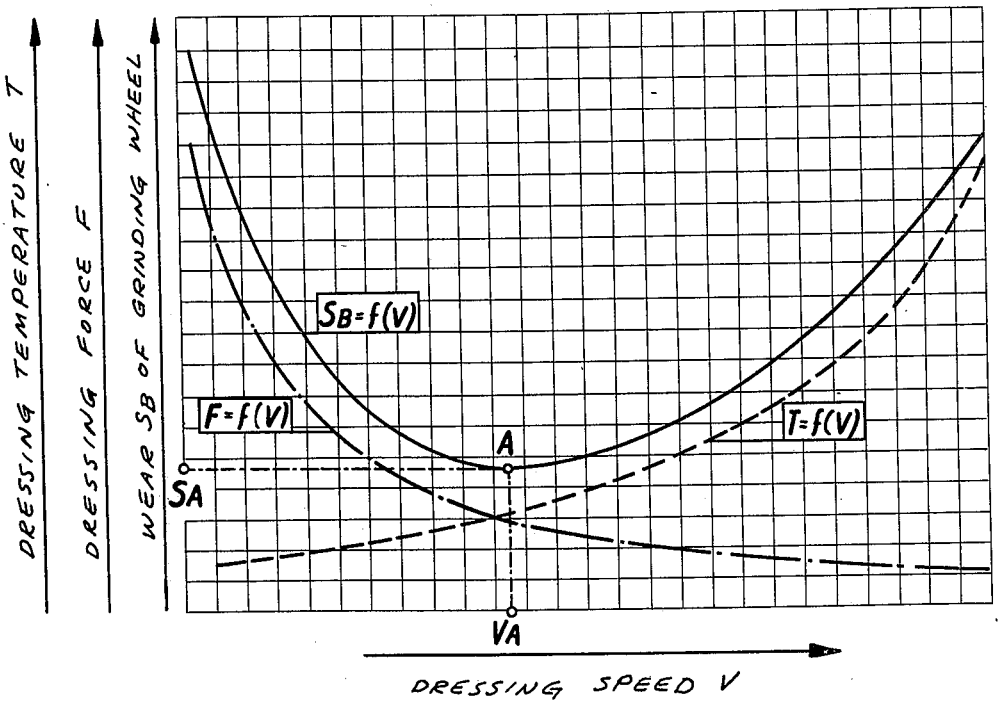
FIG. 1 is a diagram illustrating, for one operational example of the invention, the grinding temperature, the dressing force and the material removal on the grinding wheel in dependence upon the dressing speed.

Referring firstly to the diagram in FIG. 1, it will be seen that an increase in the dressing speed $v$ will in principle lead to a decrease in the cutting force or dressing force F. This is illustrated on hand of the curve $F=f(v)$. An increase in the dressing speed $v$ will, on the other hand, result in a continuous increase in the temperature T, as shown on hand of the curve $T=f(v)$.

Still another curve shown in FIG. 1 identifies the material removal or wear of the grinding wheel during the dressing operation, this wear or material removal being identified with character $S_B$ and being traced on the curve $S_B = f(v)$. It is clear that the value $S_B$ will have a minimum value A at a certain dressing speed $v_A$. It follows from this that if a large value $S_B$ is desired to be obtained, it will be advantageous to operate at a lesser dressing speed than $v_A$.

Figure 2:
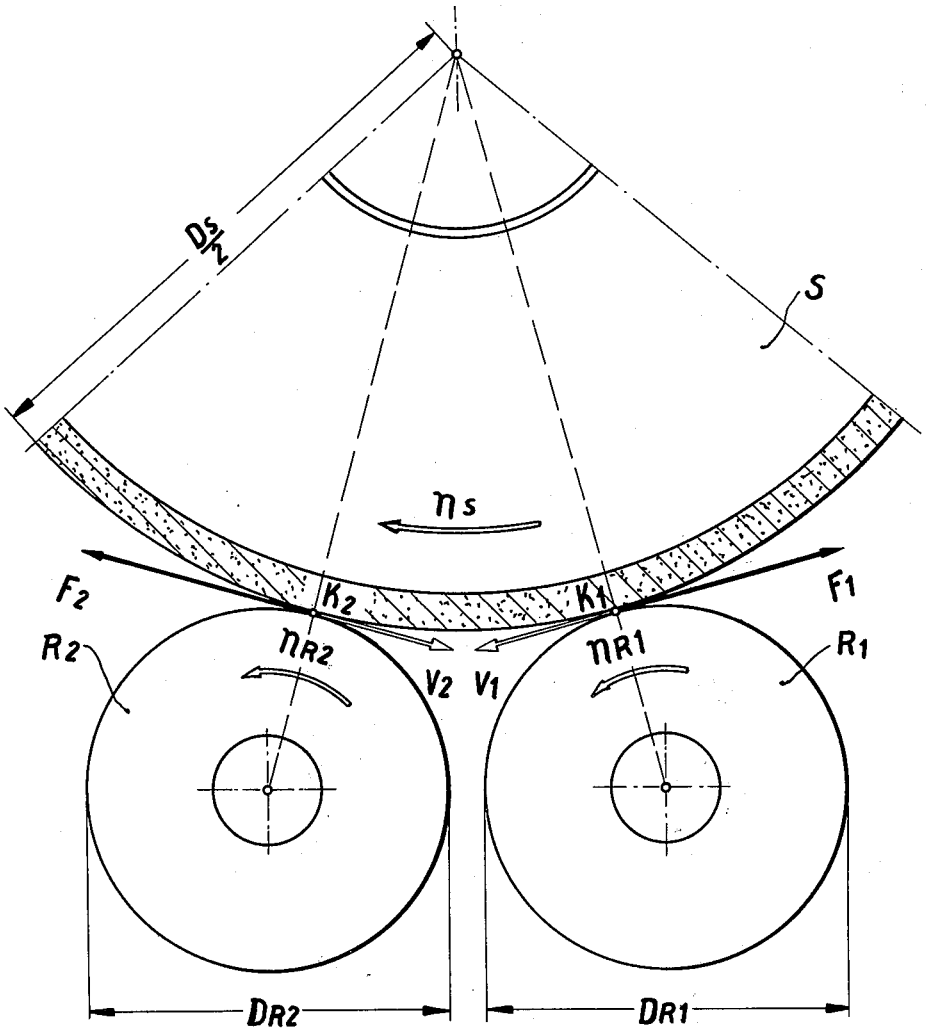
FIG. 2 is a diagrammatic view illustrating a portion of a grinding wheel and two dressing rollers, and explaining the kinematic conditions which obtain in an apparatus utilizing two such dressing rollers for dressing a grinding wheel.

Given these preliminary data, and assuming that—as shown in FIG. 2—a grinding wheel S is to be dressed by contact with two driven dressing rollers $R_1$ and $R_2$, with the grinding wheel S itself being driven in rotation, then the following kinematic relationships can be identified:

The peripheral speed $v_s$ of grinding wheel S is:

$$v_S = \pi \cdot D_S \cdot n_S \qquad 1.$$

The peripheral speed $v_{R1}$ of the roller $R_1$ is:

$$V_{R1} = \pi \cdot D_{R1} \cdot n_{R1} \qquad 2.$$

The peripheral speed $v_{R2}$ of the roller $R_2$ is:

$$v_{R2} = \pi \cdot D_{R2} \cdot n_{R2} \qquad 3.$$

wherein $D_S$ = diameter of the grinding wheel S in mm,
$D_R$ = diameter of a dressing roller in mm,
$n_S$ = rpm of grinding wheel,
$n_R$ = rpm of a dressing roller,
$n_M$ = rpm of the drive motor,
$v$ = dressing speed (hereafter also called relative dressing speed) in mm per minute of material removed.

The respectively resulting relative dressing speed between grinding wheel S and a roller $R_1$ or $R_2$ can be as follows:

$$v_1 = v_S - v_{R1} \qquad 4.$$

and $$v_2 = v_S - v_{R2} \qquad 5.$$

Taking into consideration the directions of rotations shown in FIG. 2 for the grinding wheel S, the dressing roller $R_1$ and the dressing roller $R_2$, the numerical values and directions of the resulting dressing speeds $v_1$ and $v_2$ can be determined by associating appropriate numerical values for $D_{R1}$, $D_{R2}$, $n_1$ and $n_2$.

I have carried out a large number of experiments in connection with this invention and have determined that the most advantageous results can be obtained when the vectors of the resulting dressing speed $v_2$ and $v_2$ have the directions which are shown in FIG. 2, that is if these vectors $v_1$ and $v_2$ are mutually opposite. If the dressing directions are opposite as shown in FIG. 2, any particular point of the grinding wheel S is subjected to a constantly alternating material-removing stress, as will also be evident from the directions of the cutting or dressing forces $F_1$ and $F_2$ which are opposite to the vectors $v_1$ and $V_2$. Such constantly alternating stressing of each point of the periphery of the grinding wheel S being dressed can be obtained under the assumption that:

$$v_S = \pi \cdot D_S \cdot n_S > v_{R1} = \pi \cdot D_{R1} \cdot n_{R1} \qquad 6.$$

and $$v_S = \pi \cdot D_S \cdot n_S < v_{R2} = \pi \cdot D_{R1} \cdot n_{R2} \qquad 7.$$

Under these circumstances, $$v_1 - v_S - v_{R1} = \pi\,(D_S \cdot n_S - D_{R1} \cdot n_{R1}) \qquad 8.$$

and $$v_2 = v_{R2} - v_S = \pi\,(D_{R2} \cdot n_{R2} - D_S \cdot n_S) \qquad 9.$$

The formulas (8) and (9) above indicate that any desired grinding wheel having a diameter $D_S$ and an rpm $n_S$, can be dressed at two desired resulting dressing speeds $v_1$ and $v_2$ by an association of appropriate numerical values for the factors $D_{R1}$, $D_{R2}$, $n_{R1}$ and $n_{R2}$. The apparatus which will now be described with reference to FIGS. 3 and 4 is particularly suitable for dressing in this manner.

Figure 3:
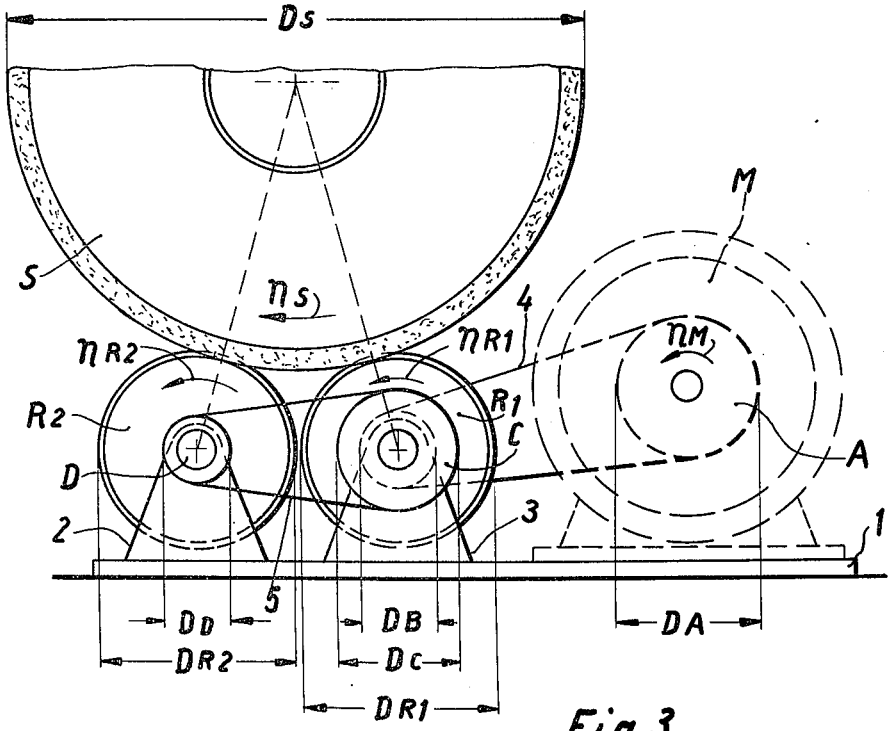
FIG. 3 is a side view, in somewhat diagrammatic illustration, of an apparatus according to an embodiment of the invention, and the kinematic relationships of which have been explained with respect to FIG. 2.
Figure 4:
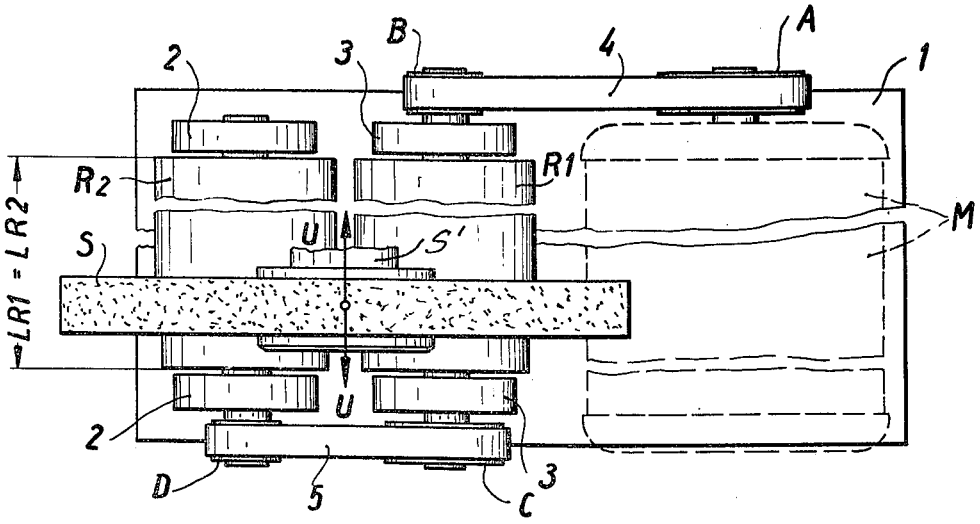
FIG. 4 is a top-plan view of the apparatus shown in FIG. 3.

FIGS. 3 and 4 illustrate an apparatus according to the present invention for dressing and sharpening a grinding wheel S which is mounted for rotation about its central axis, for instance on the shaft S′ which is diagrammatically visible in FIG. 4. The apparatus has a base plate 1 on which two mounting supports 2 and 3 are provided. A dressing roller R1 is mounted in the mounting support 3, and second dressing roller R2 is mounted in the mounting support 2, both of the rollers of course being journalled for rotation. The plate 1 additionally carries a drive motor M of any conventional type, which drives the rollers R1 and R2 in rotation.

For this purpose, the output shaft of the motor M carries a belt pulley A which drives a belt pulley B that is mounted on the shaft of the roller R1, via a first drive belt 4. The rollers R1 and R2 are kinematically connected by means of a belt pulley C on the shaft of the roller R1 and a belt pulley D on the shaft of the roller R2, as well as a second drive belt 5 which is trained about the belt pulleys C and D. The directions of rotation of the motor M, the roller R1 and the roller R2 are identified by the arrows $n_M$, $n_{R1}$ and $n_{R2}$, respectively. The direction of rotation of the grinding wheel S is identified by the arrow $n_S$. The diameters of the rollers R1 and R2 are identified by $D_{R1}$ and $D_{R2}$, respectively, and the diameters of the belt pulleys B, C and D are identified by DB, DC and DD, respectively. The diameter of the grinding wheel S is identified by DS. Given this information, the above formula (8) and (9) can be utilized to obtain the following relationships:

$$v_1 = \pi\,(D_S \cdot n_S - D_{R1} \cdot n_M \cdot DA/DB) \qquad 10.$$

and $$v_2 = \pi\,(D_{R2} \cdot n_M \cdot DA/DB \cdot DC/DD - D_S \cdot n_S) \qquad 11.$$

The equation (10) above shows that $$\frac{DA}{DB} = \frac{\pi \,.\, D_S \,.\, n_S - v_1}{\pi \,.\, D_{R1} \,.\, n_M} = \frac{v_S - v_1}{\pi \,.\, D_{R1} \,.\, n_M}$$

Calculating on the basis of the formulas (1) and (12):

$$\frac{DC}{DD} = \frac{\pi \,.\, D_S \,.\, n_S + v_2}{\pi \,.\, D_S \,.\, n_S - v_1} \cdot \frac{D_{R1}}{D_{R2}} = \frac{v_S + v_2}{v_S - v_1} \cdot \frac{D_{R1}}{D_{R2}} \qquad (13)$$

An extensive series of tests was conducted and it was found that the most advantageous dressing results are obtained when the relative dressing speeds are identical, as well as the diameter of the rollers R1 and R2, i.e., when $$v_1 = v_2 = v$$

and $$D_{R1} = D_{R2} = D_R$$

If these relationships obtain, formulas (12) and (13) are changed as follows:

$$\frac{DA}{DB} = \frac{\pi . D_S . n_S - v}{\pi . D_R . n_M} \quad (12a)$$

and $$\frac{DC}{DD} = \frac{\pi . D_S . n_S + v}{\pi . D_S . n_S - v} \quad (13a)$$

It was also found to be advantageous if the grinding wheel S is moved with respect to the rollers R1 and R2 along its longitudinal axis of rotation, as indicated by the double-headed arrow U—U of FIG. 4. This facilitates the effectiveness of the dressing operation, and this effectiveness can be still further improved if the rollers R1 and R2 have a profiled surface, that is if their circumferential surfaces are profiled rather than being even.

I have found that these circumferential surfaces of the rollers R1 and R2 can be made of commercial steel, for instance the type designated as St 37 which is a low carbon steel, and will then provide good dressing results. However, even better results can be obtained if these surfaces are made up of diamond particles or borazone particles.

It will be appreciated that using the formulas (12*a*) and (13*a*), the diameters DA, DB, DC and DD of the belt pulleys A–D, respectively, can be so selected that the grinding wheel S—having the diameter DS and the rpm speed *n*S—can be dressed by the rollers R1 and R2 at the dressing speed *v*. It should be understood that the optimum resulting dressing speed *v* will in the final analysis being dependent upon certain factors that must be taken into account, particularly the type of material constituting the surface of the rollers R1 and R2, for instance natural diamond particles, synthetic diamond particles or cubic-crystalline boron nitride, as well as the manner in which these particles are bound together by synthetic plastic resins, ceramic or metallic materials. Also important is the particle size of the diamond or other particles, the concentration of diamond or other particles per unit surface area of the rollers R1 and R2, the traverse feed *u* and the vertical infeed.

The following example will serve to further explain the concept and practice of the present invention:

If a grinding wheel S has a diameter $D_S$ of 400 mm and is rotated at an rpm *ns* of 1500 rpm, and if it is assumed that the rollers R1 and R2 have diameters $D_{R1}$ and $D_{R2}$ of 85 mm each, and the motor M has a rotational speed $n_M$ of 2800 rpm, then the formulas (12*a*) and (13*a*) can be used to calculate as follows for this particular example:

$$\frac{DA}{DB} = \frac{\pi . 400 . 1500 - 60000 . v}{\pi . 85 . 2800} = \frac{30}{119} . \frac{10\pi - v}{\pi}$$

$$\frac{DA}{DB} = \frac{30}{119} . \frac{10\pi - v}{\pi} \quad (12b)$$

and $$\frac{DC}{DD} = \frac{\pi . 400 . 1500 + 60000 . v}{\pi . 400 . 1500 - 60000 . v} = \frac{10\pi + v}{10\pi - v}$$

$$\frac{DC}{DD} = \frac{10\pi + v}{10\pi - v} \quad (13b)$$

Figure 5:
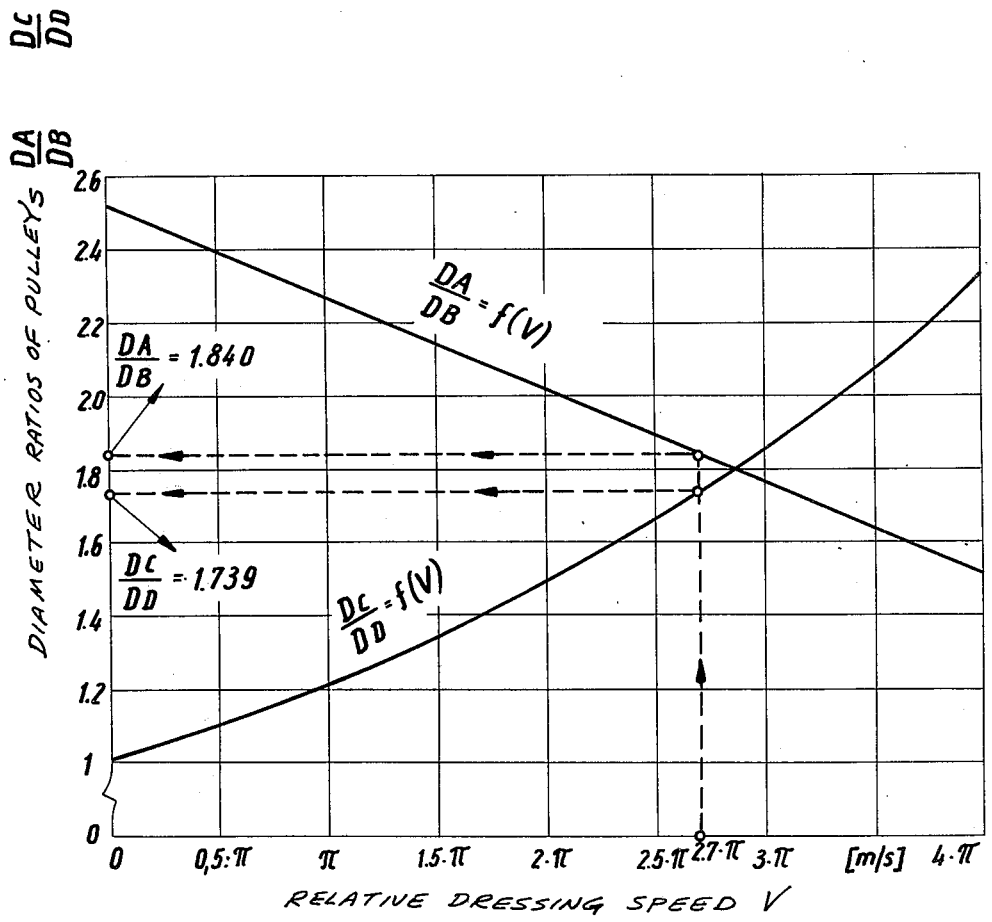
FIG. 5 is a diagram illustrating the relationship of the diameters of the drive pulleys for two dressing rollers of the apparatus in FIGS. 3 and 4 with respect to the relative dressing speed.

The relatioships resulting from the equations (12*b*) and (13*b*) can be graphically expressed in a two-coordinate system, as shown in FIG. 5. Using that Figure, the respective diameter ratios DA/DB and DC/DD for a selected dressing speed *v* can be readily ascertained. If, for example, the dressing speed is desired to be $v = 2.7 \cdot \pi \cong 8.5$ m/sec, then FIG. 5 shows that DA/DB = 1.840 mm and DC/DD = 1.739 mm.

The accuracy of these values can also be calculated as follows, using the equations (12*b*) and (13*b*):

$$\frac{DA}{DB} = \frac{30}{119} . \frac{10\pi - 2.7\,\pi}{\pi} = \frac{219}{119} \quad (13c)$$

and $$\frac{DC}{DD} = \frac{10\pi + 2.7\,\pi}{10\pi - 2.7\,\pi} = \frac{127}{73} \quad (14c)$$

These relationships are met if, e.g., $D_A = 109.5$ mm; $D_C = 63.5$ mm and $D_B = 59.5$ mm; $D_D = 36.5$ mm Under these circumstances, $$v_1 = \frac{\pi}{60000}(400 . 1500 - 85 . 2800 . \frac{109.5}{59.5}) = 2.7 . \pi$$

$$v_2 = \frac{\pi}{60000}(85 . 2800 . \frac{109.5}{59.5} . \frac{63.5}{36.5} - 400 . 1500) = 2.7\,\pi$$

thus meeting the requirement that $$v_1 = v_2 = 2.7\pi.$$

The simplicity of replacing belt pulleys with other, different-diameter belt pulleys in order to change the transmission ratios and therefore the dressing speed *v*, will be obvious from the above. It is even simpler to change the dressing speed *v* if the transmission between the motor M and the roller $R_1$, and if a second roller $R_2$ is present, the transmission between the rollers $R_1$ and $R_2$, are of the type that can be continuously varied, that is if for instance the belt pulleys A–D are variable sheaves. This makes it extremely simple to select the optimum dressing speed *v* by simply varying the diameters of the respective sheaves.

It should be noted that while in the illustrated embodiment the rollers $R_1$ and $R_2$ have been shown to have identical diameters, it is equally well possible to utilize rollers of different diameters. In that case the dressing rollers will both be rotated at identical rpm, and in effect the same results are obtained as in the illustrated embodiment, that is mutually opposite dressing directions at identical relative dressing speeds will be obtained, assuming of course that appropriate drive means are used.

It will be understood that each of the elements described above, or two or more together, may also find a useful application in other types of applications differing from the type described above.

While the invention has been illustrated and described as embodied in the dressing and sharpening of grinding wheels, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of dressing and sharpening a grinding wheel, comprising the steps of rotating a grinding wheel at a predetermined speed; contacting the grinding wheel simultaneously with two dressing rollers; and jointly driving each of said dressing rollers with a peripheral speed different from the other and being different from the grinding wheel speed and in mutually opposite dressing directions to remove material from said grinding wheel with identical relative dressing speeds.

2. A method as defined in claim 1; and further comprising the step of moving said grinding wheel along its axis of rotation during the step of dressing.

3. An apparatus for dressing and sharpening of grinding wheels, comprising mounting means mounting a grinding wheel for rotation at a predetermined peripheral speed; a pair of adjacent dressing rollers in contact with said grinding wheel; and drive means driving each of said dressing rollers at a peripheral speed different from the other and each being different from the predetermined peripheral speed of said grinding wheel and so that the dressing directions of said dressing rollers are mutually opposite and the dressing speeds are identical.

4. An apparatus as defined in claim 3, wherein said drive means comprises a motor, a first transmission connecting said motor with one of said dressing rollers and having a transmission ratio of $$\frac{DA}{DB} = \frac{v_S - v_1}{\pi \cdot D_{R1} \cdot n_M}$$

and a second transmission connecting said motor with the other of said dressing rollers and having a transmission ratio of $$\frac{DC}{DD} = \frac{v_S + v_2}{v_S - v_1} \cdot \frac{D_{R1}}{D_{R2}}.$$

5. An apparatus as defined in claim 3, wherein said rollers have identical diameters; and wherein said drive means comprises a motor, a first transmission connecting said motor with one of said rollers and having a transmission ratio of $$\frac{DA}{DB} = \frac{\pi \cdot D_S \cdot n_S - v}{\pi \cdot D_R \cdot n_M}$$

and a second transmission connecting said one roller with the other roller and having a transmission ratio of $$\frac{DC}{DD} = \frac{\pi \cdot D_S \cdot n_S + v}{\pi \cdot D_S \cdot n_S - v}.$$

6. An apparatus as defined in claim 3, wherein said rollers have different diameters; and wherein said drive means rotates said rollers at identical rpm.

7. An apparatus as defined in claim 3, wherein said drive means comprises a motor, a first transmission connecting said motor with one of said rollers, and a second transmission connecting said motor with the other of said rollers, each of said transmissions comprising at least one replaceable pulley that can be exchanged for a pulley having a different diameter, and a drive belt cooperating with said pulley.

8. An apparatus as defined in claim 3, wherein said rollers have profiled circumferentially extending faces.

9. An apparatus as defined in claim 3, wherein said rollers are of steel.

10. An apparatus as defined in claim 3, wherein said rollers are of a hard metal other than steel, i.e. tungsten carbide.

11. An apparatus as defined in claim 3, wherein said rollers are in part of low carbon steel and in part of a hard metal, i.e. tungsten carbide other than steel.

12. An apparatus as defined in claim 3, wherein said rollers are provided with a layer of diamantine material.

13. An apparatus as defined in claim 3, wherein said rollers are provided with a layer of cubic-crystalline boric nitride material.

14. An apparatus as defined in claim 3, wherein said drive means comprises a motor and a pair of transmissions which connect said motor with the respective rollers, one of said transmissions being adjustable and having a continuously variable transmission ratio.

15. An apparatus as defined in claim 3, wherein said drive means comprises a motor, a first transmission connecting said motor with one of said rollers, and a second transmission connecting said one roller with the other of said rollers, both of said transmissions being adjustable and having continuously variable transmission ratios.

* * * * *